US005905446A

United States Patent [19]

Benore et al.

[11] Patent Number: 5,905,446

[45] Date of Patent: May 18, 1999

[54] ELECTRONIC KEY SYSTEM

[75] Inventors: Randolph C. Benore, North Canton; Leo J. Grosswiller, East Canton, both of Ohio; Shawn Gibson, Newago; Donald Neidlinger, Grand Haven, both of Mich.

[73] Assignee: DieBold, Incorporated, Canton, Ohio

[21] Appl. No.: 08/822,843

[22] Filed: Mar. 24, 1997

[51] Int. Cl.[6] ..... E05G 1/00

[52] U.S. Cl. ..... 340/825.34; 340/825.31; 340/542; 340/543; 70/278; 109/53; 109/54; 109/56; 361/171

[58] Field of Search ..... 340/825.34, 825.31, 340/542, 3; 70/276–8; 109/53, 4, 58; 361/161, 171, 2; 312/315

[56] References Cited

U.S. PATENT DOCUMENTS

| | | | |
|---|---|---|---|
| 3,785,188 | 1/1974 | Drathschmidt | 70/276 |
| 3,800,284 | 3/1974 | Zucker et al. | 340/149 R |
| 4,111,474 | 9/1978 | Heydner | 292/144 |
| 4,529,234 | 7/1985 | Senften | 292/169.15 |
| 4,572,348 | 2/1986 | Eisermann et al. | 194/248 |
| 4,608,932 | 9/1986 | Bohland et al. | 109/56 |
| 4,718,705 | 1/1988 | Case | 292/201 |
| 4,777,815 | 10/1988 | Lovell et al. | 70/276 |
| 4,851,828 | 7/1989 | Yamashita | 340/825.31 |
| 4,868,914 | 9/1989 | Yamashita | 340/825.31 |
| 4,918,957 | 4/1990 | Eisermann | 70/276 |
| 4,965,551 | 10/1990 | Box | 340/545 |
| 4,972,182 | 11/1990 | Novik et al. | 340/825.32 |
| 5,009,456 | 4/1991 | Eck | 292/173 |
| 5,014,030 | 5/1991 | Aston | 335/228 |
| 5,140,317 | 8/1992 | Hyatt, Jr. et al. | 340/825.31 |
| 5,172,967 | 12/1992 | Pipe | 312/217 |
| 5,193,371 | 3/1993 | Yamane | 70/276 |
| 5,219,386 | 6/1993 | Kletzmaier et al. | 70/277 |
| 5,231,272 | 7/1993 | Mardon | 235/382 |
| 5,255,825 | 10/1993 | Warren | 340/825.31 |
| 5,337,588 | 8/1994 | Chhatwal | 710/278 |
| 5,359,322 | 10/1994 | Murray | 340/825.31 |
| 5,389,919 | 2/1995 | Warren et al. | 340/825.31 |
| 5,400,722 | 3/1995 | Moses et al. | 109/2 |
| 5,412,378 | 5/1995 | Clemens | 340/825.34 |
| 5,419,305 | 5/1995 | Hanley | 126/197 |
| 5,422,634 | 6/1995 | Okubo | 340/825.34 |
| 5,423,198 | 6/1995 | DiVito et al. | 70/278 |
| 5,456,243 | 10/1995 | Jones | 126/197 |
| 5,474,348 | 12/1995 | Palmer et al. | 292/339 |
| 5,701,828 | 12/1997 | Benore et al. | 109/56 |

*Primary Examiner*—William A. Cuchlinski, Jr.
*Assistant Examiner*—Yonel Beaulieu
*Attorney, Agent, or Firm*—D. Peter Hochberg

[57] ABSTRACT

An electronic security system for controlling access to a plurality of storage locations. The system includes an electronic lock associated with each storage location, a central control terminal for controlling operation of the security system, a programming terminal to program a plurality of keys, and an identification terminal for identifying authorized users of the security system.

16 Claims, 8 Drawing Sheets

ELECTRONIC KEY SYSTEM

FIELD OF THE INVENTION

The present invention relates generally to electronic security systems, and more particularly to an electronic security system for controlling access to a plurality of storage locations. The invention is particularly applicable for use with bank teller drawers and will be described with particular reference thereto, it being appreciated, however, that the present invention finds advantageous application in controlling access to various types of information or asset storage enclosures.

BACKGROUND OF THE INVENTION

In recent years, more and more businesses have been seeking ways to control and monitor access and dissemination of corporate information and assets. Such information may be in the form of cyberspace records stored in network computers accessible through any one of the networks computer terminals, be physical documents or objects stored in cabinets, enclosures, or financial records or currency stored in drawers. In many instances, such information, records or assets may not be so important as to require costly and elaborate security systems, but are of a level of importance that it is desirable to limit access to such material to only specific authorized individuals, and to keep track of which individuals gain access to such assets.

An example of where access to corporate assets is regulated is a cash currency drawer handled by a bank teller. Typically, a bank teller at the beginning of a work day is provided with a key which allows access to a workstation used throughout the day. The teller's cash drawer is removed by the teller from a bank vault and transferred to a teller workstation where the teller works throughout the day and interacts with bank customers. The teller drawer is positioned within a lockable cabinet at the teller workstation such that the teller may lock the drawer at the workstation and leave such workstation throughout the day, for example, for lunch and personal breaks. At the end of the day, the teller balances the cash within the particular drawer, and returns the drawer to the bank vault. In reality, the financial institution has no records of who had access to the cash drawer throughout the day, and for that matter, has no way of determining whether the individual possessing the key at a particular time is, in fact, the authorized user.

Another example where it may be desirable to control access to records or assets are sales records maintained in a corporate sales department. Only several people in a department may be authorized to access such records, but other people who may work in the department or pass therethrough, may gain access to such information. Presently, such information may be kept in a locked file cabinet where each individual authorized to review such material would have his or her own key, or a single key to the cabinet is maintained by a supervisor of such personnel.

The foregoing examples show situations where it is desirable to have a security system which allows access to only authorized users, and one wherein access by a user may be monitored as to the actual access to the secured assets or information.

While any such system should preferably be able to monitor and track access to the security information or assets, the device which enables access to such information must be relatively lightweight and capable of repetitious use throughout an average working day. Still further, in situations such as those described above, the security system should be such that the cost and complexity of the system is reasonable to the degree of security provided. More importantly, the access device must be lightweight and small enough so as to enable the user to carry such access controlling device on his or her person through the day without interfering with or burdening the user to an extent where he or she cannot perform his or her daily functions.

The present invention addresses these and other problems and provides an electronic key system which is lightweight, compact and relatively inexpensive, and provides a system which enables monitoring and control of access to lockable enclosures or storage means.

SUMMARY OF THE INVENTION

In accordance with the present invention, there is provided an electronic locking apparatus for controlling access to a plurality of storage locations. The electronic locking apparatus includes an electronic lock associated with each storage location having a locking mechanism movable between a locking condition and an unlocking condition. An electrically-excitable thermal responsive element regulates movement of the locking mechanism from the locking condition to the unlocking condition, and circuit means controls the electrical excitement of the thermal responsive element. The circuit means includes memory means for storing an access code. Receptacle means are provided for receiving a mechanical element for operative engagement with the locking mechanism and for receiving an electrical element for operative engagement with the circuit means. A portable electronic key includes an internal power source and circuit means controlling the power source. The circuit means includes programmable means for storing and conveying an access code, an electrical element connected to the power source and engageable with the receptacle means. A control system is provided for programming the electronic key. The control system includes memory means for storing access codes, receptacle means for receiving the electrical element and the mechanical element of the key, and means for imparting access code information to the controller.

In accordance with the present invention, there is provided an electronic lock system for controlling access to a plurality of storage locations, each having an openable and closeable panel. The system is comprised of a lock mechanism mounted to each of the panels. The lock mechanism has a lock member movable between a first position locking the panel and a second position unlocking the panel, and a shaped memory alloy element which is deformable when an electrical current is applied thereto, which controls movement of said lock element. Identification means are provided for identifying individuals authorized for access to one or more of panels. Processing means are provided for storing information regarding individual identification information and for identifying a panel an authorized individual is allowed access to. A portable key device is provided for use with the lock mechanisms on the panels. The key device has an internal energy source for energizing the alloy element.

In accordance with the present invention, there is provided an electronic lock system for controlling access to a plurality of storage locations. The system is comprised of a lock mechanism mounted to each of said storage locations. The lock mechanism has a mechanical lock member movable between a first position locking the storage location and a second position unlocking the storage location. Each of the lock mechanisms has electronic circuit means including memory means for storing a specific access code and a thermal responsive lock control element, allowing movement of the lock member from the first position to the second position. The lock control element is responsive when an electrical current is applied thereto. Processing means are provided for storing information regarding access codes for each enclosure lock mechanism. A portable key device is used with the lock mechanisms on the storage locations. The key device includes mechanical connection means for connection with the lock member and electronic connection means for connection with the electronic circuit means in the lock mechanism. The key device further includes memory means programmable by the processing means for storing an access code to a lock mechanism on one of the panels, and an internal electrical power source for energizing the lock control element in the lock mechanism.

It is an object of the present invention to provide an electronic key access control system for controlling and monitoring access to storage locations.

Another object of the present invention is to provide a system as described above, wherein such storage locations are comprised of a plurality of lockable enclosures.

Another object of the present invention is to provide a system as described above, wherein such storage locations are computer terminals.

Another object of the present invention is to provide an electronic key system as described above, wherein each storage location has an electronic lock having an individual electronic access code.

Another object of the present invention is to provide an electronic key system as described above, wherein each storage location has an identifiable location number.

Another object of the present invention is to provide an electronic key system as described above, wherein a single, portable programmable key device is used to control access to each of the storage locations.

Another object of the present invention is to provide an electronic key system as described above, wherein the power required to control the electronic locks is carried by a programmable electronic key device.

Another object of the present invention is to provide an electronic key system as described above, wherein a small, portable, programmable key device controls access to the storage locations.

Another object of the present invention is to provide an electronic key system as described above, wherein each storage location has a distinct access code.

Another object of the present invention is to provide a system as described above, wherein each storage location has a distinct serial number for identifying and monitoring when access to such storage location occurs.

Another object of the present invention is to provide an electronic key system as described above, which controls, monitors and records a user's activity with respect to access to storage locations.

Another object of the present invention is to provide an electronic key system as described above having an enclosure locking assembly requiring minimal operating power.

Another object of the present invention is to provide an electronic key system as described above, which utilizes a shaped memory alloy (SMA) element for controlling operation of the locking device.

A still further object of the present invention is to provide a locking device which utilizes a shape memory alloy (SMA) element for controlling locking of the device.

These and other objects will become apparent from the following description of a preferred embodiment taken together with the accompanying drawings.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF PREFERRED EMBODIMENT

Figure 1:
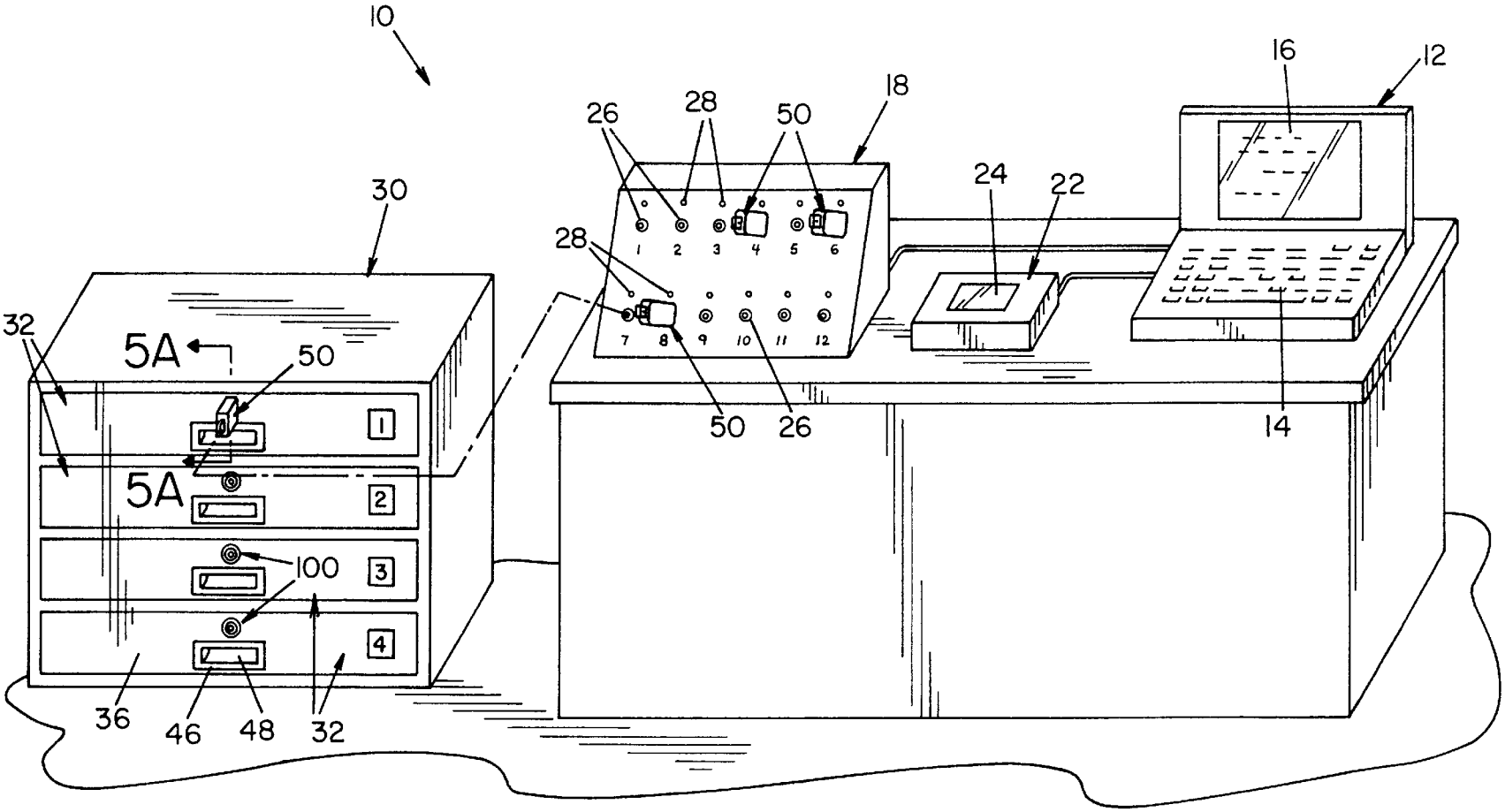
FIG. 1 is a perspective view of an electronic lock assembly comprised of a console and key module, a print reader, a computer and a plurality of bank teller drawers illustrating a preferred embodiment of the present invention.

Referring now to the drawings, where the purpose is for illustrating a preferred embodiment of the invention only, and not for the purpose of limiting same, FIG. 1 is a perspective view of an electronic lock system 10 for controlling access to bank teller drawings, illustrating a preferred embodiment of the present invention.

Broadly stated, electronic lock system 10 is generally comprised of a central control terminal 12 for storing information and for controlling operation of the lock system. Control terminal 12 includes a keyboard 14 for entering information and instructional data and a display screen 16 for displaying information and instructional prompts. In the embodiment shown, central control terminal 12 is a conventional computer.

Control terminal 12 is connected to a key programming terminal, designated 18 in the drawings, which is provided to energize and program a plurality of keys 50. An identification terminal 22 is provided to identify authorized users of the system. Terminal 22 includes an identification pad 24.

CONTROL SYSTEM

In the embodiment shown, central control terminal 12 is a conventional lap top computer having a keyboard 14 for entering information and instructional data and a display screen 16 for displaying information and instructional prompts. In the embodiment shown, identification terminal 22 is comprised of a print reader for reading thumbprint or fingerprint of a system user. As will be appreciated by a further reading of the present specification, identification terminal 22 may be comprised of other devices for identifying a system user. For example, a conventional card reader terminal for reading a magnetic encoded card may be used, or even other physical identification means such as a retina scanner or even a voice recognition device may be used. Further, mechanical devices such as IRQ meters, or dallas chips may be used for the purpose of identifying authorized users of the system. In the embodiment shown, identification terminal 22 identifies a user's print and compares such data to informational data stored in central control terminal 12.

Central control terminal 12 includes: (1) memory means for storing files relating to user identification information; (2) teller drawer identification numbers and corresponding access code for each teller drawer; (3) a verification program for verifying the user's identification information received from identification terminal 22; (4) a processor for identifying teller drawers and the corresponding access codes for such drawers, once a user's identification information has been obtained and verified with the files in memory; (5) means for writing access code information to one or more of the electronic keys 50 via key programming terminal 18; (6) means for recharging batteries within key 50, record means for maintaining financial records and use information relating of each key 50, as well as use of the system; and (7) an algorithm for generating random access code numbers.

Central control terminal 12 is connected to key programming terminal 18. Key programming terminal 18 includes a plurality of female electrical connector slots 26 for receiving electronic keys 50. Each connector slot 26 is identified by a number, i.e., 1–12, and has an indicator 28 associated therewith. Female connectors 26 within key programming terminal 18 are electrically connected to system control terminal 12. The associated indicator 28 is illuminatable to indicate a programmed key 50. Key programming terminal 18 is basically an interface between the system control terminal 12 and each key 50, to facilitate transfer of teller drawer information and access code information from control terminal 12 to key 50, and to convey use information from key 50 to control terminal 12.

Figure 2:
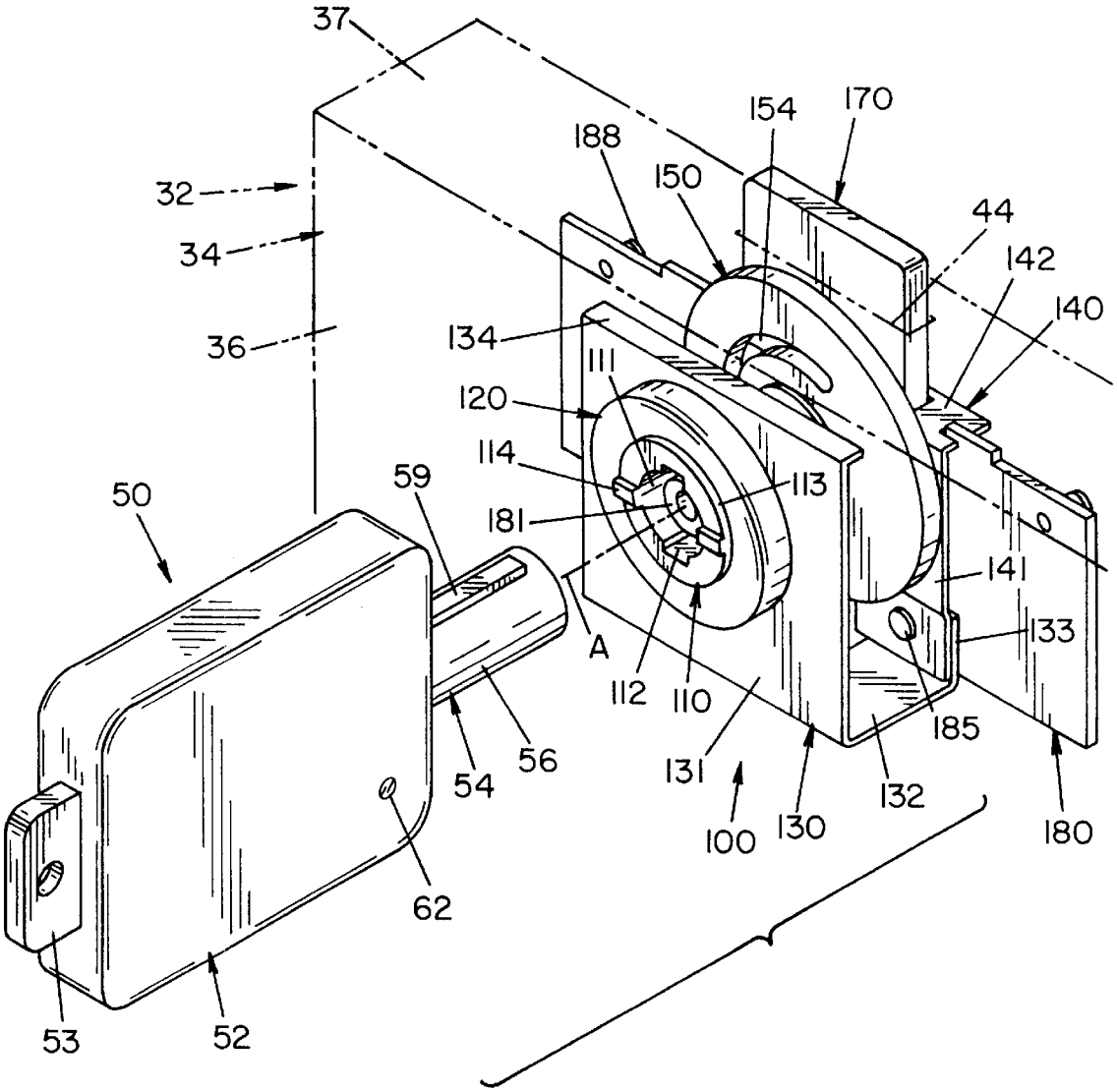
FIG. 2 is an enlarged fragmentary perspective view showing a locked teller drawer with an electronic key removed therefrom.

System 10 is intended for use with a conjunction of storage locations. In the embodiment shown, a cabinet 30 having a plurality of bank teller drawers 32 is illustrated. Each teller drawer 32 represents a storage location and includes an electronic lock assembly 100, best seen in FIG. 2, for controlling access to the teller drawer. Cabinet 30 and teller drawers 32, in and of themselves, form no part of the present invention, and therefore, shall not be described in great detail. In the embodiment shown, cabinet 30 includes four teller drawers 32, each teller drawer 32 having an electronic lock assembly 100 therein. According to the present invention, each teller drawer 32 is identified by a specific identification number.

ELECTRONIC LOCK ASSEMBLY

Figure 5A:
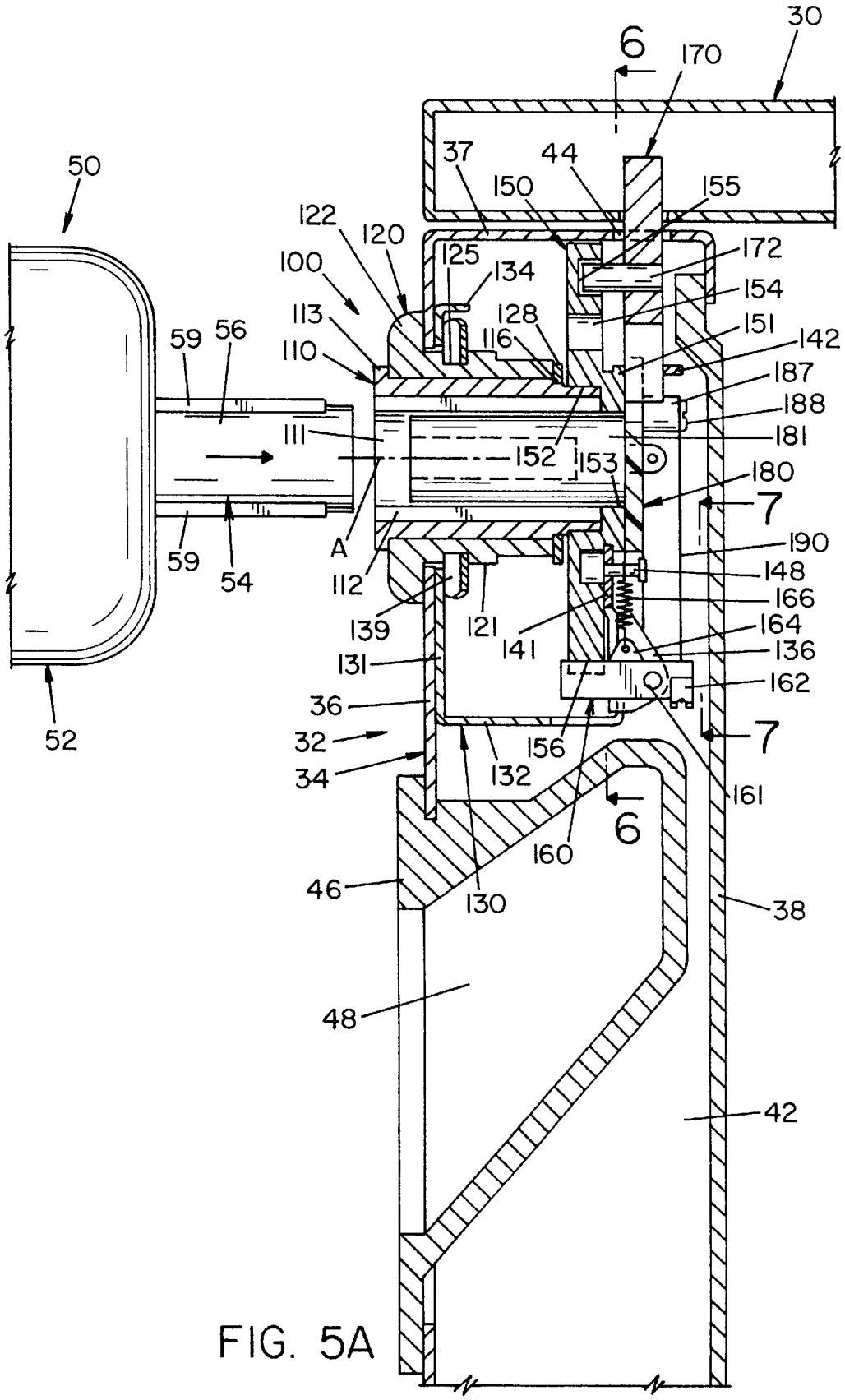
FIG. 5A is a fragmentary section taken on line 5A—5A of FIG. 1 showing the electronic key prior to insertion in security cabinet.
Figure 5B:
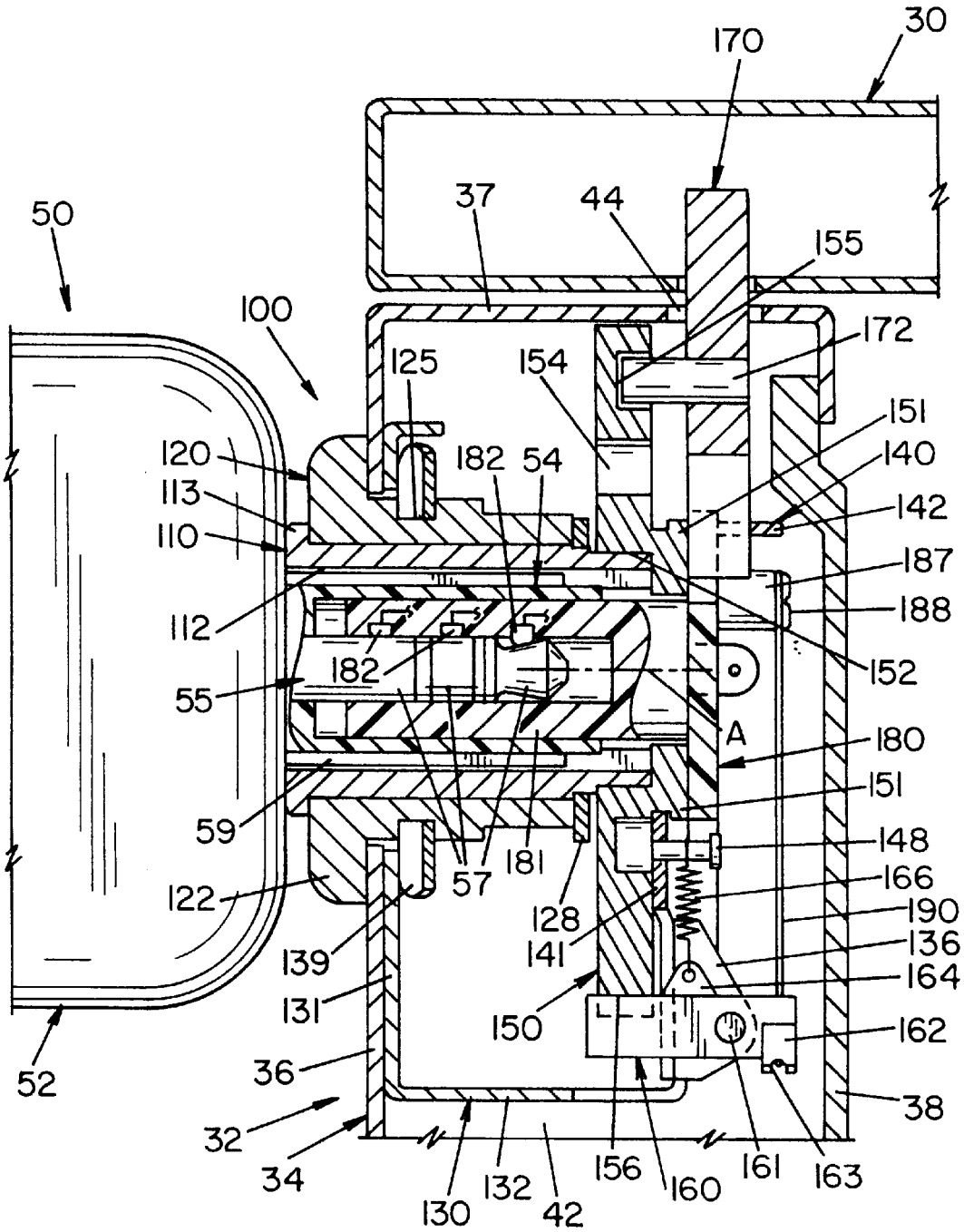
FIG. 5B is a further enlarged fragmentary view similar to FIG. 5A showing the electronic key engaged in the lock and the latch not yet released.
Figure 5C:
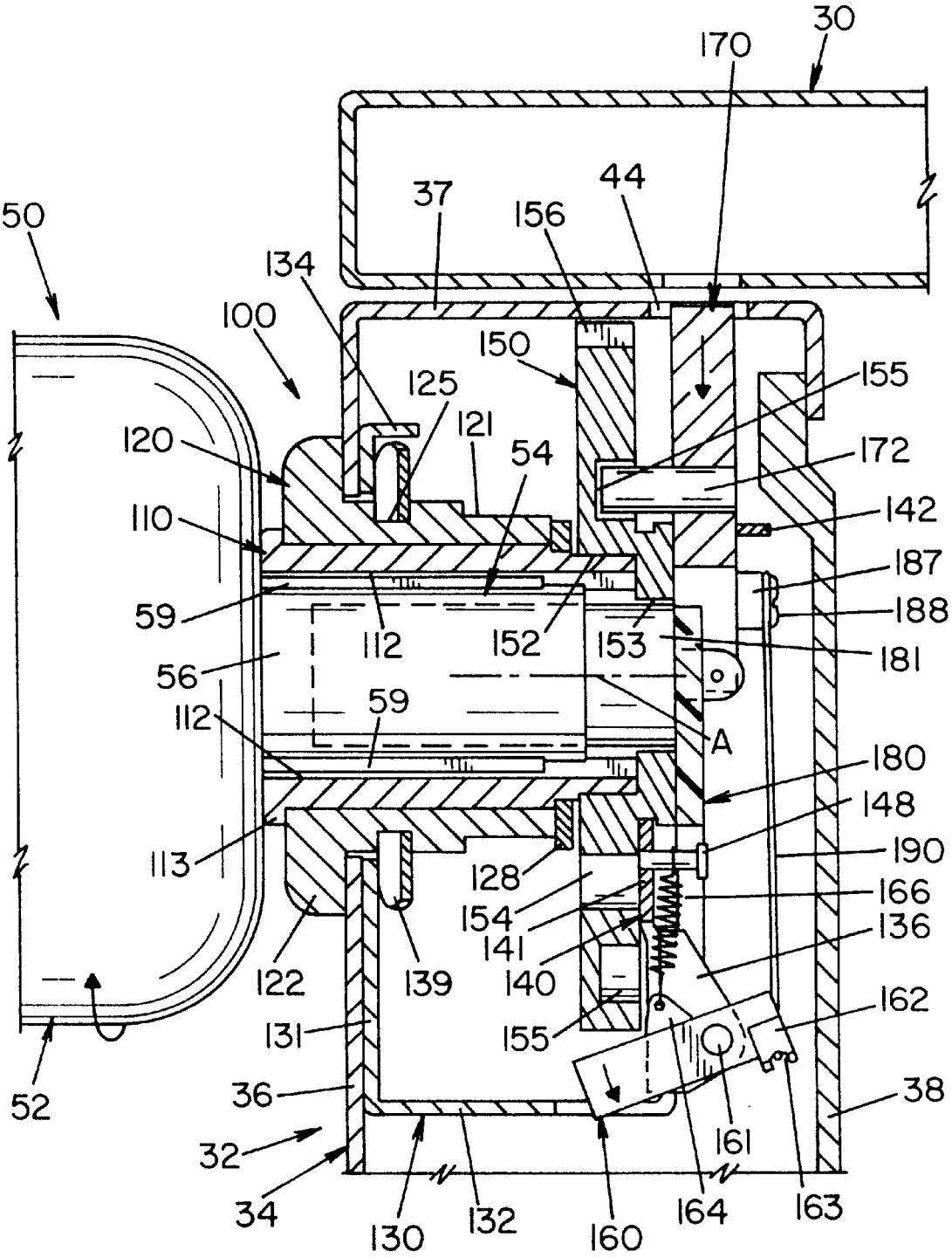
FIG. 5C is a view similar to FIG. 5B showing the latch released, electronic key rotated 180° and bolt retracted.

Lock assembly 100 is mounted within a teller drawer 32 as best seen in FIGS. 5A–5C. Specifically, each teller drawer 32 includes a front door panel 34 comprised of spaced apart walls 36, 38. Walls 36, 38 define a cavity 42 therebetween. Wall 36 includes a laterally extending extension 37 which defines the upper surface of front panel 34. A slot 44 is formed in lateral extension 37. A molded handle element 46 is mounted to wall 36 and defines a handle recess 48 within cavity 42 defined between walls 36, 38. Wall includes an aperture above handle element 46 to receive electronic lock assembly 100.

Figure 9:
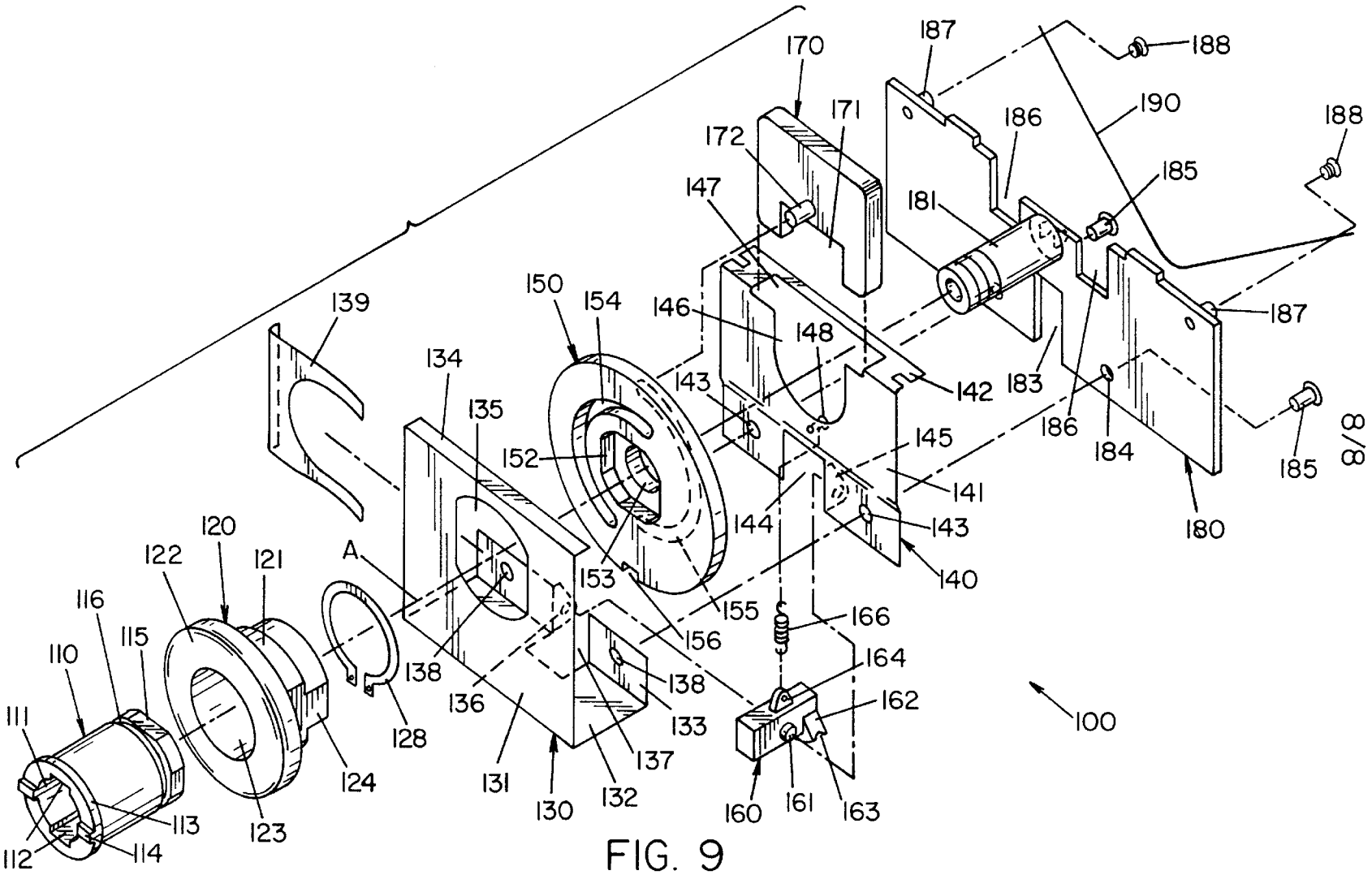
FIG. 9 is an exploded perspective view of the lock assembly.

Electronic lock assembly 100 is comprised of a number of components which are best illustrated in exploded view in FIG. 9. In FIG. 9, the respective components of lock assembly 100 are oriented along an axis, designated "A" in the drawings. Electronic lock assembly 100 includes a lock insert 110. Lock insert 110 is generally cylindrical in shape and includes an axially aligned cylindrical bore 111 extending therethrough. Opposed locating slots 112 are formed within bore 111 and extend through lock insert 110. One end of lock insert includes a circular flange 113 having aligned rails 114 formed on the surface thereof. The other end a cylindrical body includes a rectangular boss 115. An annular shoulder 116, best seen in FIGS. 5A–5C, is formed adjacent rectangular boss 115.

A lock body 120 is provided to receive lock insert 110. Lock body 120 is generally cylindrical in shape and includes a generally cylindrical body 121 having an annular flange 122 formed at one end thereof. A cylindrical bore 123 extends axially through cylindrical body 121 and is dimensioned to matingly receive lock insert 110. Opposed flat surfaces 124 are formed on opposite sides of cylindrical body 121, and opposed slots 125, best seen in FIGS. 5A–5C, are formed in cylindrical body 121 adjacent flange 122. Lock body 120 is dimensioned such that lock insert 110 extends therethrough with rectangular boss 115 and annular shoulder 116 extending beyond the end of lock body 120. A conventional retaining snap ring 128 is provided to be mounted adjacent annular shoulder 116 on lock insert 110 to axially confine lock insert 110 within lock body 120, as illustrated in FIGS. 5A–5C. In this respect, lock insert 110 is axially fixed, but rotatable within lock body 120.

A first mounting bracket 130 is provided to receive lock body 120 and lock insert 110. When viewed in cross-section, mounting bracket is generally J-shaped and includes a front panel 131, a laterally extending bottom panel 132 and a short rear panel 133 which is generally parallel to front panel 131. A lateral extending lip 134 is formed along the upper edge of front panel 131. An aperture 135 is formed through front panel 131. Aperture 135 is dimensioned generally to conform to the cross-sectional profile of the body 121 of lock body 120 and so as to receive same. Rear panel 133 includes a tab 136 extending therefrom which defines a gap 137 in rear panel 133. Spaced apart apertures 138 are formed at the distal ends of rear panel 133.

A generally C-shaped retaining clip 139 is provided to mount lock body 120 and first mounting bracket 130 to front wall 136 of door panel 34. Retaining clip 139 is dimensioned to be received within slots 125 of lock body 120 and to capture first mounting bracket 130 and wall 36 of door panel 34 against flange 122 of lock body 120, as best seen in FIG. 5A–5C. In this respect, retaining clip 139 is generally disk-shaped and formed of a spring metal, wherein clip 139 forces first mounting bracket 130 against the inner surface of wall 136 and draws flange 122 of lock body 120 against the outer surface of wall 36.

A second mounting bracket 140 is provided for attachment to first mounting bracket 130. Second mounting bracket 140 is generally L-shaped and includes a planar front panel 141 and a short rearward extending flat top panel 142 located along the upper edge of front panel 141. Two spaced apart apertures 143 are formed at the lower corners of front panel 141, which apertures 143 are dimensioned to be in registry with apertures 138 in front panel 131 of first mounting bracket 130. A rectangular notch 144 is formed in the lower end of front panel 141. Notch 144 is in registry with gap 137 in rear panel 133 of first mounting bracket 130. A tab 145, shown in phantom in FIG. 9, extends laterally from one side of front panel 141. A generally U-shaped opening 146 is formed in the upper portion of front panel 141. Opening 146 communicates with a rectangular opening or slot 147 formed in top panel 142. As indicated above, second mounting bracket 140 is adapted for attachment to first mounting bracket 130 by fastening means extending through apertures 138, 143. When joined, tab 136 on first mounting bracket 130 is parallel to and adjacent tab 145 on second mounting bracket 140. Each tab 136, 145 includes an aperture therethrough which apertures are in axial alignment.

Figure 6:
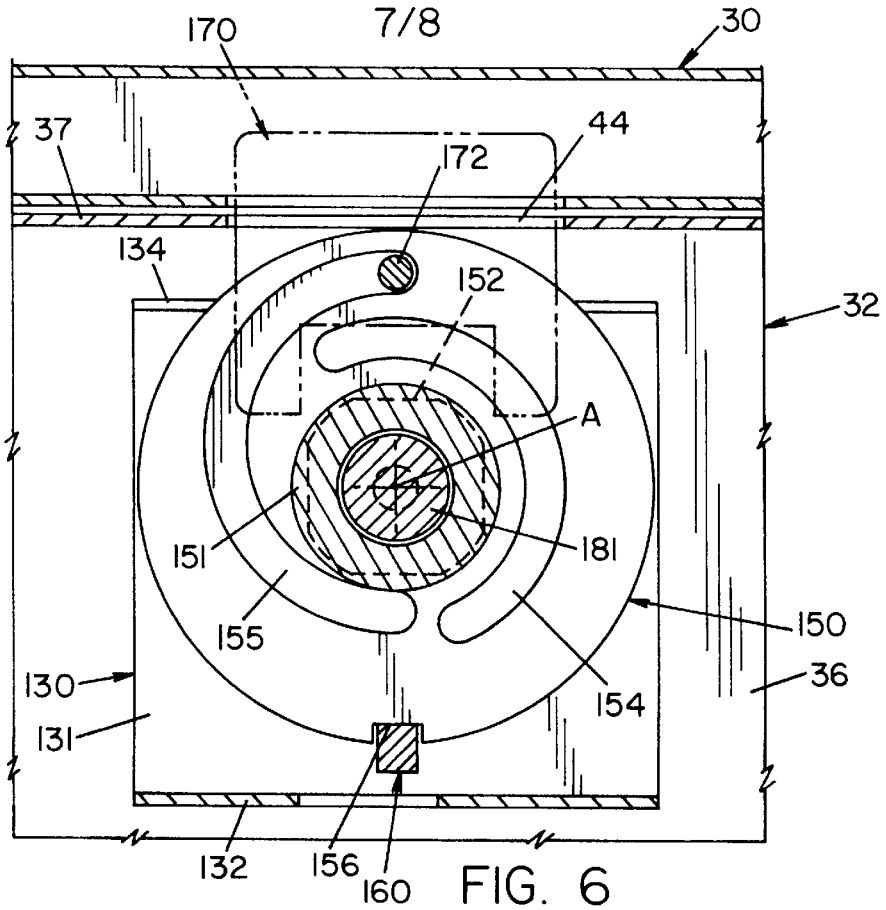
FIG. 6 is a cross-section taken on line 6—6 of FIG. 5A, showing the cam latched in its locked position.
Figure 7:
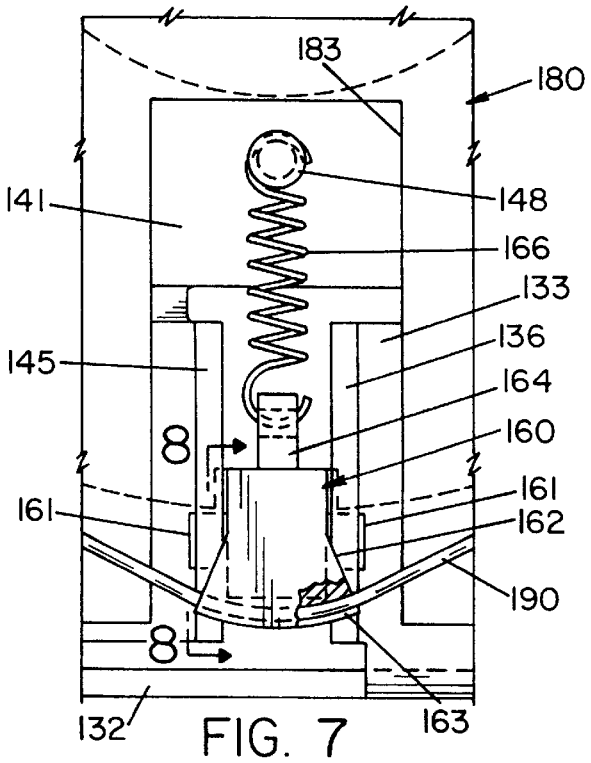
FIG. 7 is an enlarged fragmentary view taken on line 7—7 of FIG. 6 showing the SMA wire engaged with the latch.
Figure 8:
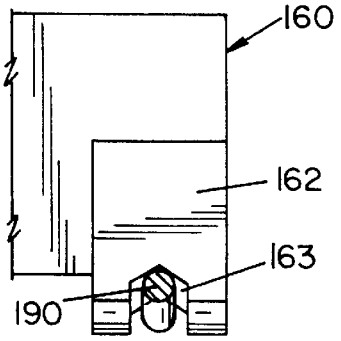
FIG. 8 is a further enlarged fragmentary view taken on line 8—8 of FIG. 7.

A cam 150 is dimensioned to be positioned between first mounting bracket 130 and second mounting bracket 140. Cam 150 is a cylindrical disk having a cylindrical hub 151, best seen in FIGS. 5A–5C, extending from one side thereof. A rectangular recess 152 is formed in one side of cam 150 to receive rectangular boss 115 on lock insert 110. A cylindrical bore 153 extends through the cylindrical hub 151 and communicates with rectangular recess 152. A first semi-circular slot 154 and a second semi-circular slot 155, best illustrated in FIG. 6, are formed within cam 150. First slot 154 extends completely through cam 150. Second slot 155 extends only partially into one side of cam 150. A rectangular notch 156 is formed at the lower end of cam 150. Cam 150 is adapted to be mounted onto lock insert 110, as illustrated in FIGS. 5A–5C, and to be rotatable therewith.

A cam latch 160 is provided to interact with cam 150. Cam latch 160 is generally a rectangular bar having aligned pins 161 extending from opposite sides thereof. A pie-shaped wedge 162 is formed at one end of cam latch 160 and includes an arcuate groove 163 therethrough. A mounting boss 164 is provided on the upper surface of cam latch 160. Cam latch 160 is dimensioned to extend through the gap 137 in front panel 131 of first mounting bracket 130 and to be received within notch 156 of cam 150. In this respect, pins 161 of cam latch 160 are mounted through the apertures in tabs 136, 145 of first and second mounting brackets 130, 140. A tension spring 166 is at one end, attached to mounting boss 164, and at the other end, to a pin 148 extending from second mounting bracket 140. Tension spring 166 is operable to bias the end of cam latch 160 toward cam 150.

A latch 170 is provided to be received within the slot 147 defined in top panel 142 of second mounting bracket 140. Latch 170 is generally a rectangular plate having a rectangular notch 171 formed in the lower end thereof. A cylindrical pin 172 extends from one side of latch 170. Pin 172 is dimensioned to be received within first circular slot 154 of cam 150. Latch 170 is generally movable in a vertical direction based upon rotation of cam 150.

A printed circuit board 180 is mounted to second mounting bracket 140. A female electrical connector 181 extends from one side of printed circuit board 180. Connector 181 includes internal contact rings 182, best seen in FIG. 5B, which contact rings are electrically connected to the circuit on printed circuit board 180. Connector 181 is dimensioned to extend through notch 171 in latch 170, through opening 146 in second mounting bracket 140, through bore 153 in cam 150, through aperture 135 in first mounting bracket 130, and into bore 111 of lock insert 110. Electrical connector 181 is positioned to be axially aligned along the axis of lock insert 110. The other side of printed circuit board 180 includes electrical circuit components (not shown) for controlling operation of lock assembly 100, as will be described in greater detail below. Printed circuit board 180 includes a notched opening 183 dimensioned to enable one end of cam latch 160 to extend therethrough. Apertures 184 are provided on opposite sides of opening 183. Apertures 184 are in registry with apertures 138, 143 in first and second mounting brackets 130, 140, and are adapted to receive fasteners 185 to secure printed circuit board 180 to second mounting bracket 140, and to secure second mounting bracket 140 to first mounting bracket 130. Notches 186 are formed in the upper portion of printed circuit board 180 to receive the lower end of latch 170, as best seen in FIG. 3.

Figure 3:
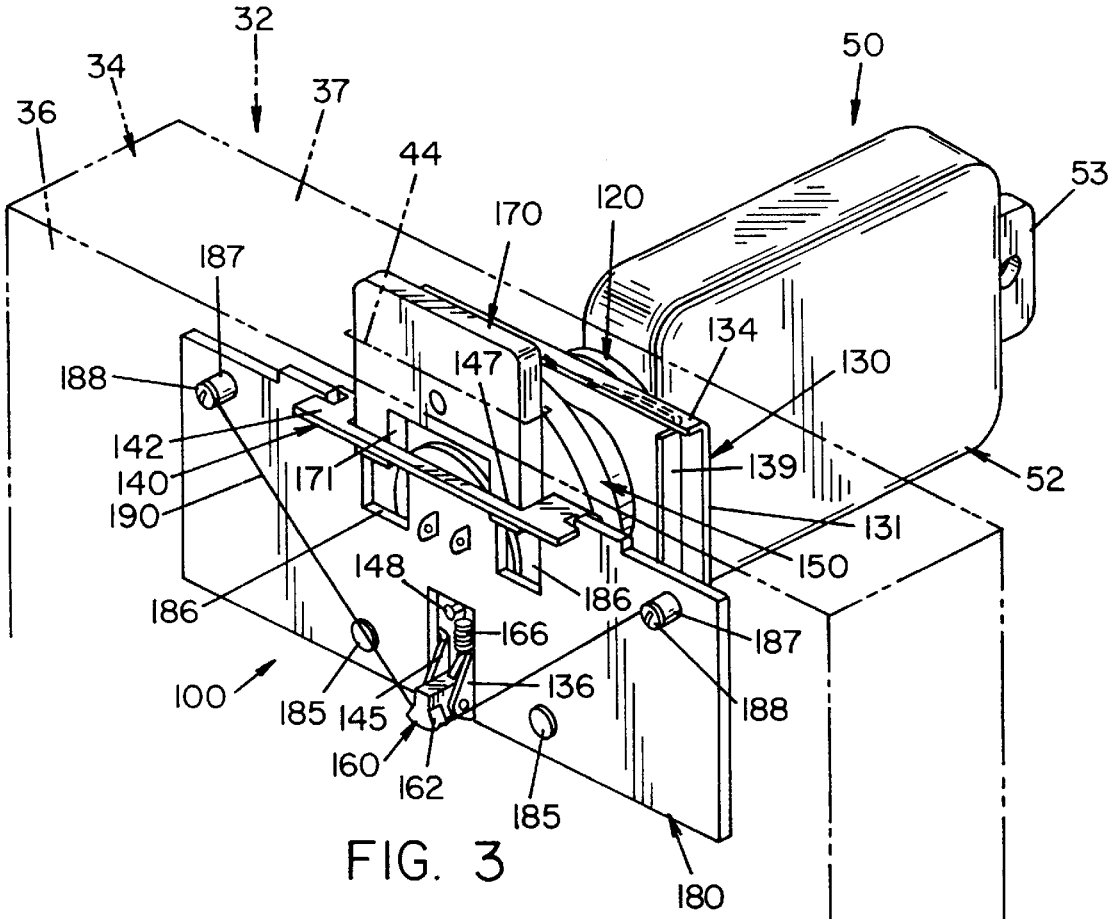
FIG. 3 is a fragmentary perspective view from inside the teller drawer showing the electronic key inserted and the SMA wire not yet retracted releasing the latch.

A pair of electrical connector posts 187, as best seen in FIG. 3, extend from one side of printed circuit board 180. Posts 187 are spaced apart and are located in the upper corners of printed circuit board 180 in electrical contact with the circuit thereon. A thermal responsive shape memory alloy (SMA) wire 190 is mounted to posts 187 by fasteners 188. Wire 190 extends around cam latch 160, and is located within groove 163 of wedge 162. As shown in FIG. 3, wire 190 forms a generally V-shaped configuration. Wire 190 is preferably comprised of a nickel-titanium wire, such as FLEXINOL® 100 LT.

ELECTRONIC KEY

Figure 4:
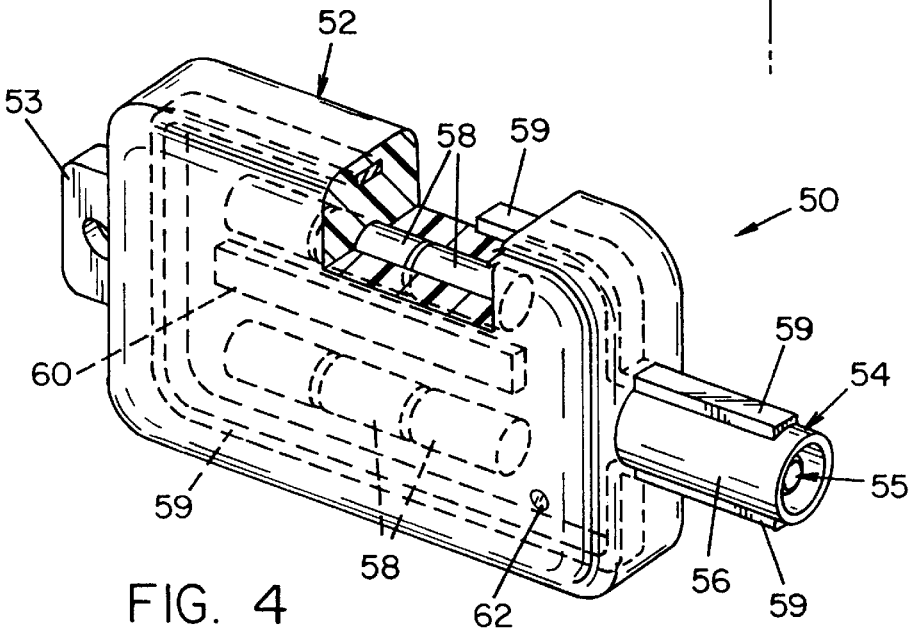
FIG. 4 is a further enlarged perspective view of the electronic key with parts broken away.

Referring now to key 50, as best seen in FIG. 4, each key 50 is basically comprised of a body portion 52 having a connector portion 54 extending therefrom. Connector portion 54 is generally comprised of a male connector 55 surrounded by cylindrical protective sleeve 56. Male connector 55, as best seen in FIG. 5B, is generally cylindrical in shape and includes a plurality of spaced apart contact bands or regions 57. Male connector 55 is dimensioned to be received within female connector 181. In the embodiment shown, male connector 55 is a conventionally known, three-conductor phone plug connector and female connector 181 is a conventionally known, three-conductor phone jack.

Body portion 52 is generally rectangular in shape and is generally formed of a durable plastic material. Body portion 52 is preferably of molded construction, and includes a tab 53 extending from one side thereof. Tab 53 includes a hole to receive a key ring, cord or the like. A reinforcing bar 59 is embedded within the molded body portion 52, and is shaped to extend about the periphery of the body portion 52 immediately beneath the surface thereof. The ends of reinforcing bar 59 extend from molded body portion 52 on opposite sides of sleeve 56. The ends of bar 59 are parallel to each other and parallel to male connector 55. The ends of reinforcing bar 59 are dimensioned to be received within slots 112 of lock insert 110, as illustrated in FIGS. 5A–5C.

Molded within body portion 52 is a power supply, comprised of a plurality of rechargeable batteries 58 and a circuit board 60. Batteries 58 and circuit board 60, which are schematically illustrated in FIG. 4, are electrically connected to each other to annular contact bands 57 on male connector 55. In a preferred embodiment of the present invention, batteries 58 consist of six 1.2 volt batteries for a total of 7.2 volts. The electronic circuit on circuit board 60 preferably includes a processor including (1) a clock device for monitoring time; (2) a device for communicating with printed circuit board 180 of lock assembly 100 and with control terminal 12; (3) communication device for controlling communication processing speeds; (4) a comparator device for comparing the access code stored in memory of lock assembly 100 with an access code programmed into key 50; (5) memory means for storing information regarding use of key 50; and (6) a light emitting diode, designated 62, as an indicator.

OPERATION

Referring now to the operation of system 10, each teller drawer 32 has a specific identification drawer number. In the drawing, the four teller drawers 32 have been designated "1," "2," "3" and "4". Each teller drawer 32 also has a corresponding access code comprised of an eight digit hexadecimal number which is stored in memory in circuit board 180 of electronic lock assembly 100. One and only one access code is assigned to each teller drawer 32, and no two teller drawers 32 have like access codes.

The access code for each teller drawer 32 is preferably programmed into memory of each lock assembly 100 at the installation site. A "laptop," "notebook" or "desktop" computer having a special connector for attachment to lock assembly 100 may be used to program the access code to each teller drawer 32. The access codes and corresponding teller drawer numbers are stored in memory in system controller 12.

The system controller 12 is preferably programmed to launch a start-up routine when it is activated. The program will show a start-up screen on display screen 16 instructing a user to input a personal identification number (PIN). If the PIN is entered incorrectly, or if no user has been assigned the entered PIN, an alert screen will notify the user. If a valid PIN is entered, the user will be prompted to place his or her finger on identification terminal pad 24. The user may be prompted to place their finger several times onto identification terminal pad 24 for verification. If the user's fingerprints do not match stored information corresponding to the entered PIN number, the user will be informed, otherwise, the user will be given his or her appropriate access level.

In a preferred embodiment of the present invention, three levels of access exist. One level is a user level for a person which has access to specific teller drawers 32. A second level is a monitor level for an individual which can monitor use of system 10 and monitor activities of each user based upon the information stored in the system controller 12, as will be discussed in greater detail below. The third level is a system operator level for an individual which has maximum clearance and has authority to add users, monitor use of system 10, and add or delete other system operators, monitors or users. The system operator may control which teller drawers 32 to which a user of system 10 may access.

For an identified user, the system will authorize a specific key 50 inserted on key programming terminal 18 to be used by the user. Key 50 will be identified by illuminating indicator 28 above the associated key 50. Key 50 may also be identified by the associated number on the key programming terminal 18, which number may be identified on the display panel 16.

According to the present invention, the programmed key 50 may be programmed by the system controller to operate one or more of teller drawers 32. In this respect, key 50 may be repeatedly used to open or close an authorized teller drawer 32. The memory means within key 50 records each use of a particular teller drawer 32, i.e., each time an attempt is made to open a teller drawer 32. According to the present invention, key 50 records each attempt to open a teller drawer 32 and records the teller drawer number, even if the teller drawer 32 is not one of those authorized for access by the system controller terminal 12.

Referring more specifically to the physical operation of key 50 and lock assembly 100, FIGS. 5A–5C show insertion of key 50 into lock assembly 100. Specifically, connector portion 54 of key 50 is inserted within bore 111 of lock insert 110. The ends of reinforcing element 59 act as guides and are aligned with slots 112 in lock insert 110 to align male connector 55 within female connector 181. In FIG. 5A, lock assembly 100 is in a locked configuration and connecting portion of key 50 is about to be inserted into lock insert 110. In FIG. 5B, pin connector portion 54 has been inserted into lock insert 110. In FIG. 5B, lock assembly 100 is still in the lock position with annular band 57 on male connector 55 in electrical contact with annular connectors 182 on female connector 181. In this position, electronic circuit 60 within key 50 electronically communicates with circuit board 180 within lock assembly 100. The access code stored in memory within key 50 is then compared to the access code stored in memory within lock assembly 100. If the access code stored in memory within key 50 matches the access code stored in memory in lock assembly 40, electronic circuit within lock assembly 100 is operable to electrically energize wire 190. The power to energize wire 190 is provided by batteries 59 within key 50. Preferably, key 50 provides 5 volts and a current of 180 milliamps. The current is pulsed on and off. The electrical energy applied to wire 190 creates an increase in temperature which results in shrinkage of wire 190. The reduction in length of wire 190 causes cam latch 160 to pivot about pins 161 and to be removed from notch 156 in cam 150, as shown in FIG. 5C. With cam 150 removed from notch 156, cam 150 is free to be rotated by rotation of key 50 in a clockwise direction. Rotation of cam 150 causes pin 172 of latch 170, which is confined within slot 154, to move downward thereby removing latch 170 from opening in the upper portion of the teller cabinet 30, as also illustrated in FIG. 5C. Teller drawer 32 may then be opened, and the contents obtained by the user of system 10. Teller drawer 32 may be relocked by closing teller drawer 32 and rotating cam 150 back to its original position, wherein latch 160 extends into the opening in cabinet 30. When cam 150 returns to its initial position and key 50 is withdrawn therefrom, removal of electric current applied to 190 will cause it to expand back to its original configuration. With the force on cam latch 160 removed, tension spring 166 returns cam latch 160 to notch 156, thereby locking cam 150, and in turn, teller drawer 32.

The foregoing description is a specific embodiment of the present invention. It should be appreciated that this embodiment is described for purposes of illustration only, and that numerous alterations and modifications may be practiced by those skilled in the art without departing from the spirit and scope of the invention. It is intended that all such modifications and alterations be included insofar as they come within the scope of the invention as claimed or the equivalents thereof.

Having described the invention, the following is claimed:

1. An electronic locking apparatus for controlling access to a plurality of storage locations comprising:

an electronic lock associated with each storage location including a locking mechanism movable between a locking condition and an unlocking condition, an electrically-excitable thermal responsive element regulating movement of said locking mechanism between said locking condition and said unlocking condition, said thermal element being responsive to electrical current pulses, a circuit means controlling the electrical current pulses provided to said thermal responsive element, said circuit means including memory means for storing an access code; and receptacle means associated with each electronic lock, said receptacle means provided for receiving a mechanical element for operative engagement with said locking mechanism and for receiving an electrical element for operative engagement with said circuit means;

a portable electronic key including an internal power source, circuit means controlling said power source, said circuit means including programmable means for storing and conveying an access code, an electrical element connected to said power source and engageable with said receptacle means, and a mechanical element engageable with said receptacle means; and a control system for programming said electronic key including memory means for storing access codes, receptacle means associated with said control system for receiving said electrical element and said mechanical element of said electronic key; and circuit means for imparting access code information to said circuit means of said electronic key.

2. An electronic lock system for controlling access to a plurality of storage locations, each having an openable and closeable panel, said system comprised of:

a lock mechanism mounted to each of said panels, said lock mechanism having a lock member movable between a first position locking said panel and a second position unlocking said panel, and a shaped memory alloy element having a shrunken state when an electrical current is applied thereto and a normal state when no electrical current is applied to said alloy element, said element causing said lock member to be in said first position when said element is in said normal state and causing said lock member to be in said second position when said alloy element is in said shrunken state;

identification means for identifying individuals authorized for access to one or more of said panels;

processing means for storing information regarding individual identification information and for assigning an access code for a panel that an authorized individual is allowed to access; and a portable key device for use with said lock mechanisms on said panels, said key device having memory means programmable by said processing means for storing an access code to a lock mechanism on one of said panels, said key device having an internal energy source for energizing said alloy element.

3. An electronic lock system as described in claim 2, wherein:

said lock mechanism includes a memory means having a specific access code stored therein and said key device communicates to said lock mechanism a specific access code stored in said memory means of said key device and said circuit means allows electric current to be pulsed to said alloy element when said specific access code of said lock mechanism matches said specific access code of said key device.

4. An electronic lock system as described in claim 3, wherein said shaped memory alloy element has a first end and a second end, said alloy element being connected to said locking member between said first and second end.

5. An electronic lock system for controlling access to a plurality of storage locations, said system comprised of:

a lock mechanism mounted to each of said storage locations, said lock mechanism having a mechanical lock member movable between a first position locking said panel and a second position unlocking said panel, each of said lock mechanisms having electronic circuit means including memory means for storing a specific access code and a thermal responsive lock control element responsive to heat created by applying electrical current pulses to said lock control element, the responsiveness of said lock control element allowing movement of said lock member from said first position to said second position;

processing means for storing information regarding access codes for each enclosure lock mechanism; and a portable key device for use with said lock mechanisms on said panels, said key device including mechanical connection means for connection with said lock member and electronic connection means for connection with said electronic circuit means in said lock mechanism, said key device further including memory means programmable by said processing means for storing an access code to a lock mechanism on one of said panels, and an internal electrical power source for energizing said lock control element in said lock mechanism.

6. An electronic locking system comprising:

lock means having a plurality of locking mechanisms movable between a locked condition and an unlocked condition, each said locking mechanism including an electrically-excitable thermally responsive shaped memory alloy wire element for regulating movement of said locking mechanism between said locked condition and said unlocked condition;

electronic key means engageable with said plurality of locking mechanisms for contact with said thermally responsive element; and programming means for programming operation of said electronic key means.

7. An electronic locking system according to claim 6, wherein said lock means further comprises circuit means for controlling the electrical excitement of the said thermally responsive shaped memory alloy wire element.

8. An electronic locking system according to claim 7, wherein said circuit means includes memory means for storing an access code.

9. An electronic locking system according to claim 6, wherein said locking system further comprises a receptacle means for receiving a mechanical element for operative engagement with said locking mechanism and for receiving an electrical element for operative engagement with said circuit means.

10. An electronic locking system according to claim 7, wherein said electronic key means includes programming means for storing an access code and conveying said access code to said circuit means.

11. An electronic locking system according to claim 9, wherein said electronic key includes said electrical element connectable to a power source and engageable with said receptacle means, and said mechanical element engageable with said receptacle means.

12. An electronic locking system according to claim 6, wherein said programming means includes memory means for storing a plurality of access codes, and circuit means for imparting access code information to said electronic key means.

13. An electronic locking system according to claim 7, wherein said circuit means for controlling the electrical excitement of the said wire element applies current pulses to said wire element, said wire element being responsive to the current pulses by entering a shrunken state causing said lock mechanism to move from said locked condition to said unlocked condition, said wire element returning to its original shape upon removal of the current pulses causing said lock mechanism to move from said unlocked condition to said locked condition.

14. An electronic locking system according to claim 7, wherein said wire element has a first end and a second end, said wire element being connected to said locking member between said first and second end.

15. An electronic locking system according to claim 14, wherein said first end is connected to a first connector terminal and said second end is connected to a second connector terminal, said first and second terminal being attached to said circuit means at oppositely disposed sides of said locking member.

16. An electronic locking system according to claim 15, wherein said wire element is in a V-shaped configuration.

* * * * *